United States Patent [19]

Cooper

[11] Patent Number: 4,532,739

[45] Date of Patent: Aug. 6, 1985

[54] ROOF RIDGE CAPPING SYSTEM

[75] Inventor: Christopher A. Cooper, Cranbrook, England

[73] Assignee: Marley Tile A.G., Switzerland

[21] Appl. No.: 355,745

[22] PCT Filed: Nov. 28, 1980

[86] PCT No.: PCT/GB80/00204

§ 371 Date: Mar. 9, 1982

§ 102(e) Date: Mar. 9, 1982

[87] PCT Pub. No.: WO82/00314

PCT Pub. Date: Feb. 4, 1982

[30] Foreign Application Priority Data

Jul. 23, 1980 [GB] United Kingdom ..... 8024104

[51] Int. Cl.[3] ..... E04D 1/30; E04D 3/40

[52] U.S. Cl. ..... 52/57; 52/465

[58] Field of Search ..... 52/43, 57, 63, 465, 52/466, 276, 277, 278, 550, 551, 60, 90, 716, 717, 726, 461, 94, 58, 59

[56] References Cited

U.S. PATENT DOCUMENTS

| | | | |
|---|---|---|---|
| 2,984,945 | 5/1961 | Campbell | 52/57 |
| 3,818,663 | 6/1974 | Adlam . | |
| 4,015,374 | 4/1977 | Epstein et al. . | |
| 4,045,928 | 9/1977 | Malott | 52/465 X |
| 4,080,083 | 3/1978 | Malott . | |
| 4,322,934 | 4/1982 | Cooper | 52/57 |

FOREIGN PATENT DOCUMENTS

| | | | |
|---|---|---|---|
| 1949035 | 4/1971 | Fed. Rep. of Germany | 52/57 |
| 2017537 | 10/1971 | Fed. Rep. of Germany | 52/57 |
| 2259920 | 6/1974 | Fed. Rep. of Germany | 52/57 |
| 2846025 | 4/1980 | Fed. Rep. of Germany . | |
| 496413 | 11/1919 | France . | |
| 7040573 | 1/1972 | France . | |
| 2383288 | 11/1978 | France | 52/278 |
| 1103501 | 2/1968 | United Kingdom . | |

*Primary Examiner*—John E. Murtagh

*Attorney, Agent, or Firm*—Bacon & Thomas

[57] ABSTRACT

Apparatus for attaching rigid, conventional ridge tiles to a roofing structure is disclosed wherein elongated members extend along either side of the roof ridge so as to support the lateral edges of the conventional ridge tiles. The ridge tiles are supported on both elongated members such that the tiles extend over the ridge of the roof. Since the tiles merely rest against the elongated members, a plurality of locating and retaining straps are utilized to retain the ridge tiles on the elongated members. Each locating and retaining strap passes over a portion of the conventional ridge tile and engages a portion of the elongated members to form the sole means for retaining the ridge tiles in position. The elongated members have upwardly extending retaining portions so as to retain the nibs of conventional roofing tiles adjacent the roof ridge. Also, end pieces are provided which may be fastened to the elongated members to cap the ends at the roof ridge.

7 Claims, 9 Drawing Figures

ROOF RIDGE CAPPING SYSTEM

This invention relates to the capping of roof ridges.

It is known to cap tiled roofs with ridge tiles of e.g. concrete or clay which are bedded with mortar onto the roof tiles. Such a system has certain disadvantages because of the quantity of mortar required, subsequent cracking due to settlement and the need for skilled labour. It is also known to employ ridge tiles which overlap, the complete assembly being nailed or otherwise secured to the roof with or without the use of mortar. This is still however somewhat labour intensive and time consuming.

In German Patent Application No. P2846025.5 there is disclosed a system utilising a plastics ridge cap provided with flanges which can be nailed to roof battens, the flanges having means for locating the nibs of the top line of tiles on the roof.

While such an arrangement has considerable advantages it does not allow for the use of conventional ridge tiles where desired for reasons of economics or e.g. appearance.

It is an object of the present invention to provide a roof ridge capping system in which conventional ridge tiles can, if desired, be employed whilst permitting simple location of such tiles.

Accordingly the invention provides a roof ridge capping system comprising a pair of elongate members securable to a roof adjacent to and either side of a ridge thereon, a plurality of capping members positionable over the ridge of the roof to provide a cap therealong, and a plurality of locating elements adapted to pass over the capping members and interlocking with means provided on each of said elongate members whereby to hold said capping members in position.

Thus, whilst conventional capping members, e.g. ridge tiles, can be employed, it is possible to locate them without the use of mortar. In a particularly preferred arrangement the locating elements serve not only to hold the ridge tiles in place, but to provide a weather proof joint between adjacent ridge tiles. Thus, the locating elements—which can for example be in the form of bands or straps of a suitable plastics material or a metal—are used in such a way as to bridge the adjacent ridge tiles. The undersurface of each element can, if required, be provided with a separate seal to extend between the element and the outer surfaces of the two ridge tiles. Such a seal is conveniently in the form of a flexible rubber or synthetic rubber strip preferably provided with ridges on the surface facing the the ridge tiles. The strip may be provided with a number of openings so as to engage over lugs projecting from the locating element, the lugs being relatively thin in the longitudinal direction of the ridge and extending between the two adjacent ridge tiles. The lugs thus further assist in ensuring that the locating element is centrally positioned over the ridge tiles between the joint between two adjacent ridge tiles.

The locating elements may interlock with the elongate members in any desired fashion, but preferably form a snap fit. Thus each member may be formed with a longitudinally extending enlarged portion of e.g. circular cross section, the locating elements having at either end an inwardly curved and preferably a C-shaped portion adapted to be resiliently engaged over the enlarged portions. The arrangement is preferably such that there can be relative rotation between the C-shaped portions and the enlarged member portions. This permits adjustment of the elongate member orientation to take into account varying roof pitches. The locating element will generally be pre-formed into the shape of an arc or the like, but should have a degree of resilience to account for varying conditions and to permit the engagement with the elongate member.

Preferably at least one of the elongate members is in the form of a generally U-shaped member, one leg of which is in the form of a flange on which the bottom of a ridge tile is to rest, the flange being provided at its free end with the enlarged portion to engage with the locating elements. The other leg is adapted to be secured to a roof rafter by means of nails or the like passing through suitable apertures.

The said other leg may be provided with a longitudinally extending abutment facing the said one leg, over which the nib of a tile can be located in the manner disclosed in German Patent Application No. P2846025.5 aforementioned. In general, for a duo-pitch roof, both elongate members will be of this type, although for a mono pitch roof only one will be so formed.

End caps are preferably provided for capping the ends of the ridge. An end cap may be in the form of a plate of any desired shape to give the correct outward appearance, provided with a peripheral flange which lies over the end ridge tile to secure the end of the ridge tile and also to provide weathering. The plate may be secured to the elongate member by means of screws or like fasteners. In a particularly advantageous arrangement an enlarged portion for engagement with the locating elements has a bore extending therethrough in which such a screw or the like may engage. The inner surface of the bore may be of castellated cross section to assist in gripping the screw. The outer surface of the plate may be provided with markings simulating tile slips used in conventional ridge capping.

The ridge capping system above described can be used in combination with a verge system of the general type disclosed in German Patent Application No. P2846275.1 and in particular with the improved verge member disclosed in PCT Patent Application No. PCT/GB80/00205 of even date herewith claiming priority from U.K. Patent Application Nos. 8024103 and 7940986. In such an arrangement the elongate member of the ridge system is provided at its free end with a longitudinally extending slot so that a box-like verge member can be slid onto the member with its upper end securely located and supported. The ridge system end cap will then cover not only the ridge tiles and elongate members but also the upper end of the verge member. Tongues on the verge member overlie the end cap to assist in location.

The various components can all be made from a suitable plastics material or a metal by any convenient moulding technique. The elongate members are preferably extruded in continuous lengths. As with the systems disclosed in German Patent Application No. P2846025.5, filler units may be employed to improve the weathering of the tiles where such are located in the U-shaped elongate members. Such filler units could be made of a dense expanded plastics foam, contoured to the shape of the tiles, or be other units of the type disclosed in German Patent Application No. P2846025.5.

An embodiment of the invention will now be described by way of example and with reference to the accompanying drawings, in which.

Figure 1:
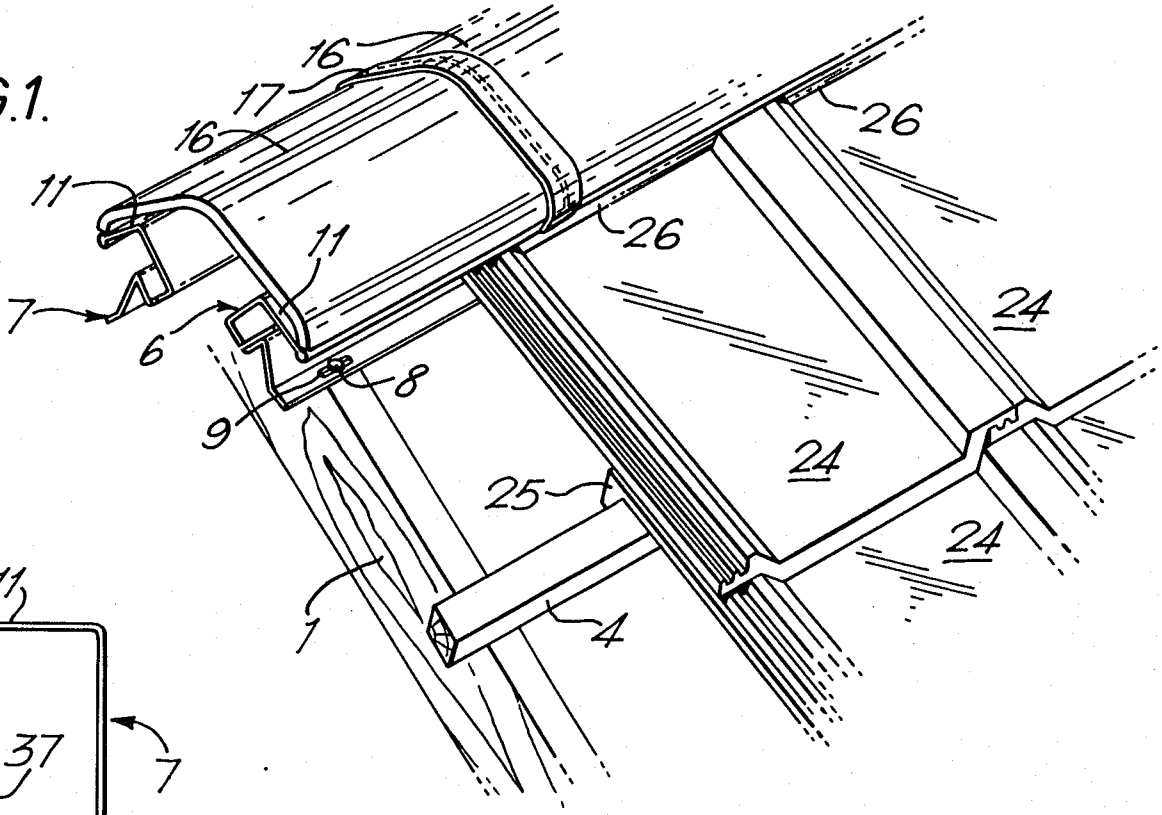
FIG. 1 is a perspective view of part of the ridge of a roof, embodying a capping system in accordance with the invention.

Referring now to the drawings, the roof shown includes wooden rafters 1 and 2 meeting at the ridge and joined together in a conventional fashion with a plate 3. To the rafters are secured wooden tile battens 4 and 5, again in a conventional fashion with e.g., nails. Roofing felt, now shown, will generally be held in place by the batten nails. Either side of the ridge is secured an elongate member, 6,7, by means of nails 8, passing through slots 9 into the rafters 1 and 2.

Figure 3:
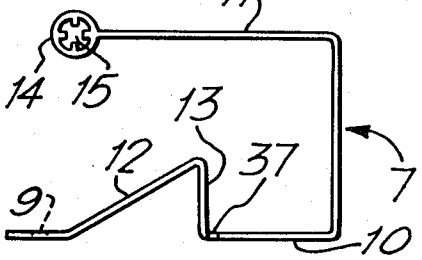
FIG. 3 is a section through an elongate member used in the capping system.

As shown in FIG. 3, each member is of U-section being of extruded plastics material. Each member has a bottom flange 10, having the apertures 9, and a top flange 11. The bottom flange 10 is provided with an upwardly projecting portion 12 of ramp-like formation, having an inwardly directed face 13. The outermost end of the top flange 11 is provided with an enlarged portion 14 of circular cross section, provided with a castellated bore 15 along its length.

Conventional ridge tiles 16 are placed along the ridge with their lower edges resting on upper flanges 11 of members 6 and 7. The ridge tiles are held in place by means of locating straps 17 provided at the joints between two adjacent ridge tiles. The straps are of a flexible plastics material. At each end of a strap 17 is provided an inwardly curved portion 18 adapted to snap over the portions 14 on flanges 11. Thus straps 17 pass over the ridge tiles and hold them down. Along the centre line of the strap 17 are provided lugs 19 which pass between the two adjacent ridge tiles to ensure that strap 17 is centrally positioned. There are also provided flanges 20 which pass between the ridge tiles but also define C-shaped members with portion 18 so as to assist in locating straps 17 on portions 14 of flanges 11. The arrangement is such that members 6 and 7 can rotate with respect to straps 17, about the axes of portions 14, to permit roofs of different pitches to be accommodated.

Lugs 19 also serve to locate a seal 21, positioned between a strap 17 and the ridge tiles 16, the lugs passing through apertures 22 in the seal. The lower face of the seal—which can be of any suitable rubber or synthetic rubber, is provided with ridges 23 which assist in sealing.

Figure 2:
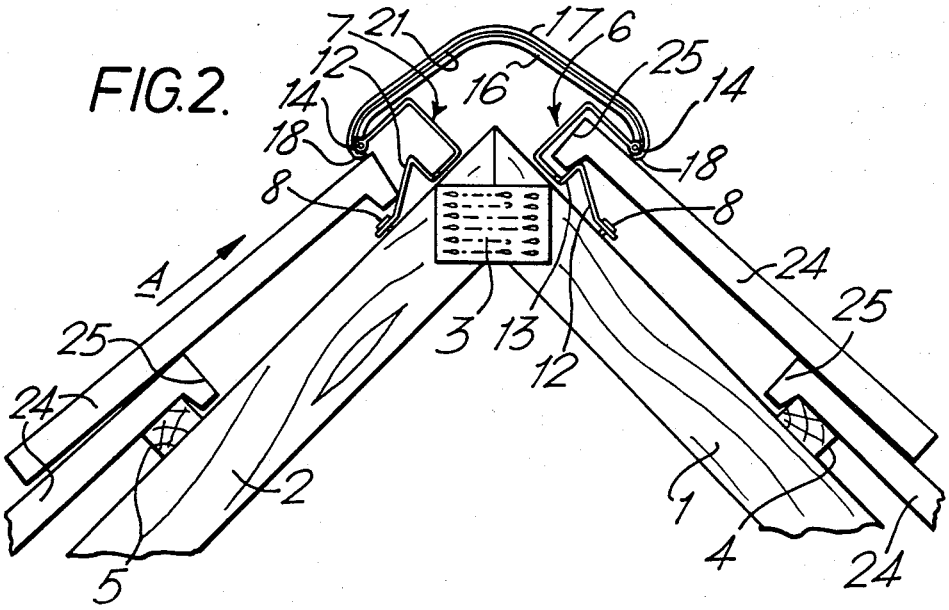
FIG. 2 is an end view of the ridge of FIG. 1.
Figure 4:
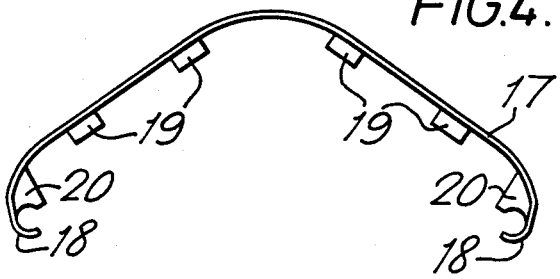
FIG. 4 is an end view of a locating element used in the capping system.
Figure 5:
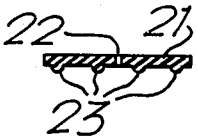
FIG. 5 is a section through a seal used in the capping system.
Figure 6:
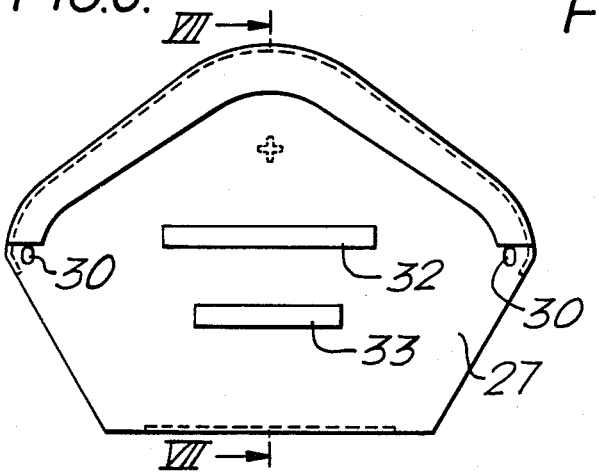
FIG. 6 is an end view of an end cap used in the system.
Figure 7:
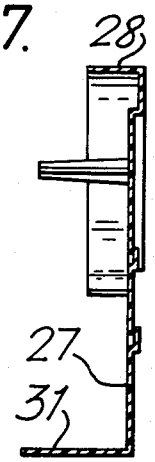
FIG. 7 is a section on the line VII—VII on FIG. 6.

The roof is provided with conventional roof tiles 24 having nibs 25. The next to uppermost line of tiles have their nibs located over battens 4 and 5 in the conventional manner. The uppermost line of tiles, however, extend into the U-shaped members 6 and 7 and have their nibs located over portions 12, resting against faces 13. This is effected simply, by pushing the tiles upwardly, as shown in the direction of arrow A on the lefthand side of FIG. 2. The U-shaped members provided weathering of the upper ends of the top line of tiles and the dimensions are preferably such that the upper flanges 11 bear down on the upper faces of the tiles. Resiliency of members 6 and 7 permits this, and of course permits insertion of the tiles as described above.

As can be seen in FIG. 1, tiles 24 are profiled and to take this into account filler units 26 of expanded plastics foam are provided to ensure complete weathering. Alternatively, plastics inserts of U-section could be used, one leg being contoured at its free end match the surface of the tile. The other leg is longer and is trapped behind the upper end of the tile.

At the end of the roof ridge, an end cap 27 is employed. This end cap has an upper, peripheral flange 28 to locate and weather the last ridge tile on the roof. The cap 27 is secured by means of screws such as screw 29 (FIG. 9) passing through aperture 30 into castellated bores 15 of members 6 and 7. The end cap has a lower flange 31 to complete weathering and to improve the appearance from underneath, and markings 32 and 33 to simulate tile slips used in conventional ridge systems.

Figure 8:
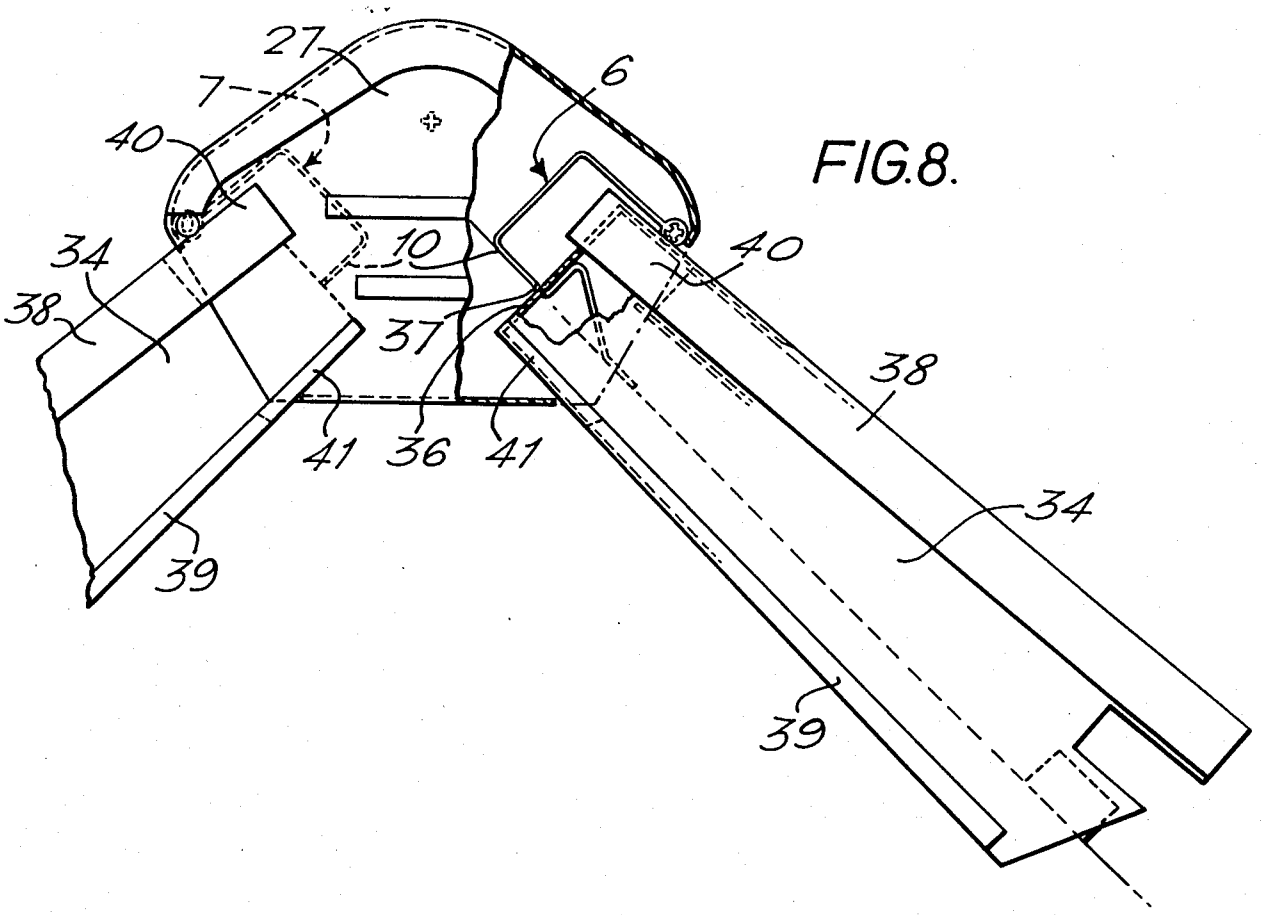
FIG. 8 is an end view showing the assembly of end cap and verge member in the system.
Figure 9:
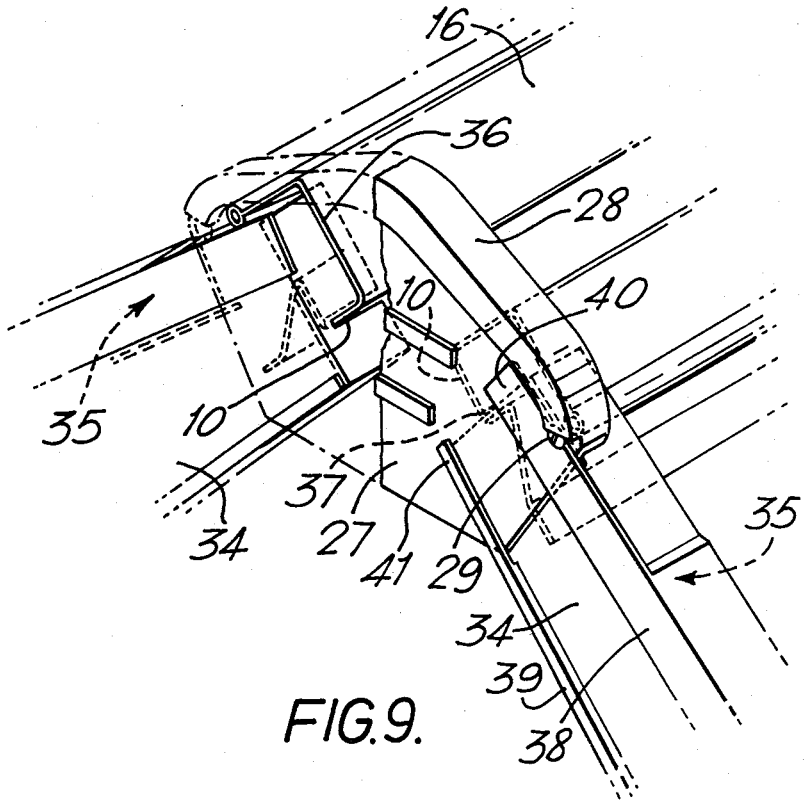
FIG. 9 is a perspective view of the assembly of FIG. 8.

As shown in FIGS. 8 and 9, at the end of the roof the ridge system interlocks with a verge system described more fully in the PCT Application aforesaid of even date herewith. The verge system consists of box-like verge members 34 which telescopically engage down the verge of the roof. Each member has a channel 35 to receive the edge of a tile and provide weathering. As can be seen, the upper ends of verge members 34 are located behind end cap 27. Each verge member has an end face 36 and to account for this, bottom flanges 10 of members 6 and 7 are provided with slots 37 to receive the faces, this serving also to locate the upper ends of verge members 34. These slots are formed by sawing at the point of installation.

Members 34 are provided with portion 38 and 39 to simulate the appearance of a conventional tiled roof, these portions also assisting in the telescopic engagement of two adjacent verge members. The ends of portions 38 and 39 are respectively formed as tongues, 40 and 41 which extend outside cap 27. Thus the verge members are slotted onto the cap 27 as well as onto the flanges 10.

There is thus provided a complete ridge capping and verge system which requires less labour than conventional systems, provides good weathering, and yet simulates the appearance of a conventional roof. whilst the invention has been described particularly to the use of conventional abutting ridge tiles, overlapping ridge tiles could be used. In that case a different locating element would be used, having separate portions for bearing down on each of two tiles which are overlapped.

I claim:

1. In a roofing structure, a system for attaching conventional ridge tiles along a ridge of the roofing structure, comprising:

(a) a pair of elongated members, each elongated member having a top flange, secured to the roofing structure adjacent to and on either side of the ridge such rigid conventional ridge tiles may be placed on the elongated members, such that they bear against an upper surface of the top flange and extend over the ridge; and, (b) locating means extending over a portion of the rigid conventional tile from one elongated member to the other, the locating means comprising a strap element having at each end thereof inwardly curved portions which snap-fit in direct contact together with respective top flanges of the elongated members to retain the conventional tiles in position over the ridge.

2. The attachment system according to claim 1 wherein the elongated members each have a lower flange such that the members have a generally U-shape cross-section, the lower flange being secured to roof rafters, and wherein each upper flange includes an enlarged portion to which the inwardly curved portions of the strap elements are engaged.

3. The attachment system of claim 2 wherein the lower flange is provided with an upwardly directed portion which nibs of roof tiles engage to retain the roof tiles in position.

4. The attachment system of claim 1 further comprising sealing elements disposed between the strap element and the conventional tile.

5. The attachment system of claim 1 wherein each strap element has at least one inwardly directed portion which passes between adjacent ridge tiles.

6. A roofing system comprising:

(a) a pair of elongated members secured to the roof adjacent to and on either side of a ridge of the roof;

(b) a plurality of rigid, conventional capping members extending over the roof ridge and supported on either edge portion by the elongated members;

(c) a top flange formed on each elongated member and extending therefrom so as to support the capping members thereon, such top flanges extending inwardly toward the roof ridge beneath the capping members and being upwardly inclined such that an inner edge of each flange is disposed above the edge portions of the capping members; and, (d) locating and retaining strap elements extending over the capping members, the strap elements having at each end thereof inwardly curved portions which snap-fit in direct contact with respective top flanges so as to retain the capping members thereon.

7. In a roofing structure, a system for attaching ridge tiles formed of a rigid material such as cement, clay or the like, along a ridge of the roofing structure, comprising:

(a) a pair of elongated members, each elongated member having a top flange, secured to the roofing structure adjacent to and on either side of the ridge such that the rigid, ridge tiles may be supported on an upper surface of the top flange such that they extend over the ridge; and, (b) locating and retaining strap means extending over a portion of the rigid tile from one elongate member to the other, the locating and retaining strap means having inwardly curved portions which snap fit interlock in direct contact with the top flange of the elongated members thereby forming the sole means for attaching the ridge tiles to the elongate members.

* * * * *